US005912405A

United States Patent [19]

Schneider et al.

[11] Patent Number: 5,912,405

[45] Date of Patent: Jun. 15, 1999

[54] ENHANCERS SUCH AS ACETOSYRINGONE

[75] Inventors: Palle Schneider, Ballerup; Ture Damhus, Copenhagen Ø, both of Denmark

[73] Assignee: Novo Nordisk A/S, Bagsvaerd, Denmark

[21] Appl. No.: 08/793,022

[22] PCT Filed: Sep. 27, 1995

[86] PCT No.: PCT/DK95/00384

§ 371 Date: Feb. 20, 1997

§ 102(e) Date: Feb. 20, 1997

[87] PCT Pub. No.: WO96/10079

PCT Pub. Date: Apr. 4, 1996

[30] Foreign Application Priority Data

| | | | |
|---|---|---|---|
| Sep. 27, 1994 | [DK] | Denmark | 1109-94 |
| Aug. 25, 1995 | [DK] | Denmark | 0952/95 |
| Sep. 19, 1995 | [DK] | Denmark | 1044/95 |

[51] Int. Cl.[6] ..... C11D 3/386; C11D 3/395; D06P 3/02

[52] U.S. Cl. ..... 8/111; 510/305; 510/312; 510/320; 510/374; 510/376; 510/392; 8/137; 8/401

[58] Field of Search ..... 510/305, 312, 510/320, 376, 374, 392; 4/137, 401, 111

[56] References Cited

U.S. PATENT DOCUMENTS

| | | | |
|---|---|---|---|
| 5,700,769 | 12/1997 | Schneider et al. | 510/305 |
| 5,752,900 | 5/1998 | Pedersen et al. | 8/111 |

FOREIGN PATENT DOCUMENTS

| | | |
|---|---|---|
| WO 91/05839 | 5/1991 | WIPO . |
| WO 92/18683 | 10/1992 | WIPO . |
| WO 92/18687 | 10/1992 | WIPO . |
| WO 94/12621 | 6/1994 | WIPO . |
| WO 96/06930 | 3/1996 | WIPO . |
| WO 96/10079 | 4/1996 | WIPO . |
| WO 96/12845 | 5/1996 | WIPO . |
| WO 97/11217 | 3/1997 | WIPO . |
| WO 97/25468 | 7/1997 | WIPO . |
| WO 97/40127 | 10/1997 | WIPO . |
| WO 97/40229 | 10/1997 | WIPO . |
| WO 97/41215 | 11/1997 | WIPO . |
| WO 97/42825 | 11/1997 | WIPO . |

OTHER PUBLICATIONS

Shuttleworth, et al "Soluble and Immobilized Laccase as Catalyst for the Transformation of Substituted Phenol" *Enzyme Microb Technology,* vol. 76 pp. 171–177, 1985.

Shuttlewor, et al., Enzyme Microb Technol, vol. 8, Mar. 1986.

Kawai, et al., Wood research, vol. 76, 1989.

Chadwick, et al., Chemical Abstract.

Alexandra et al., Chemical Abstract.

Kata, et al, Plant Cell Physiol. 26(7), 1291–1301 (1985).

*Primary Examiner*—Kery Fries

*Attorney, Agent, or Firm*—Steve T. Zelson; Elias J. Lambiris; Carol E. Rozek

[57] ABSTRACT

The invention is directed to a method of bleaching dye or colorant in solution which comprises a phenol oxidizing enzyme (e.g. A peroxidase or a laccase) and an enhancing agent (e.g. acetosyringone).

10 Claims, 1 Drawing Sheet

ENHANCERS SUCH AS ACETOSYRINGONE

CROSS-REFERENCE TO RELATED APPLICATIONS

This application is a 35 U.S.C. 371 national application of PCT/DK95/00384 filed Sep. 27, 1995 and claims priority under 35 U.S.C. 119 of Danish application 1109/94 filed Sep. 27, 1994, 0952/95 filed Aug. 25, 1995 and 1044/95 filed Sep. 19, 1995, the contents of which are fully incorporated herein by reference.

FIELD OF INVENTION

The invention relates to a method of oxidizing a compound with a phenol oxidizing enzyme and an enhancing agent. The invention also relates to a detergent additive and to a detergent composition.

BACKGROUND ART

By a phenol oxidizing enzyme is meant an enzyme which by using hydrogen peroxide or molecular oxygen, is capable of oxidizing organic compounds containing phenolic groups. Examples of such enzymes are peroxidases and oxidases.

It has earlier been found that coloured substances leached from dyed fabrics could be bleached by means of a phenol oxidizing enzyme. The use of peroxidases or oxidases for inhibiting dye transfer in this way is described in WO 91/05839.

Certain oxidizable substances, e.g., metal ions and phenolic compounds such as 7-hydroxycoumarin, vanillin, and p-hydroxybenzenesulfonate, have been described as accelerators or enhancing agents able to enhance enzymatic bleaching reactions (cf. e.g. WO 92/18683, WO 92/18687, and Kato M and Shimizu S, Plant Cell Physiol. 1985 26 (7), pp. 1291–1301 (cf. Table 1 in particular)). In WO 94/12621 other types of enhancing agents are disclosed, e.g., phenothiazines and phenoxazines.

It is the object of this invention to provide a new group of enhancing agents which are effective for enhancing phenol oxidizing enzymes.

SUMMARY OF THE INVENTION

It has now surprisingly been found that a new group of organic chemical substances performs excellently as enhancers of phenol oxidizing enzymes.

This new group of organic chemical substances not only make the bleaching reactions faster compared with using the phenol oxidizing enzyme alone, but many compounds which could not be bleached at all, may now be bleached by using the method of the invention.

Accordingly, the invention provides a method of oxidizing a compound with a phenol oxidizing enzyme, characterized by the presence of an enhancing agent of the following formula:

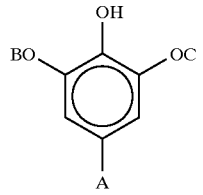

in which formula A is a group such as —D, —CH=CH—D, —CH=CH—CH=CH—D, —CH=N—D, —N=N—D, or —N=CH—D, in which D is selected from the group consisting of —CO—E, —$SO_2$—E, —N—XY, and —$N^+$—XYZ, in which E may be —H, —OH, —R, or —OR, and X and Y and Z may be identical or different and selected from —H and —R; R being a $C_1$—$C_{16}$ alkyl, preferably a $C_1$—$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

BRIEF DESCRIPTION OF THE DRAWING

The present invention is further illustrated by reference to FIG. 1 which shows the bleaching of gradually added Acid Blue 45 in phosphate/borate buffer pH 10 at 35° C.; (I): Only dye addition; (II): Dye addition in the presence of Laccase; (III): Dye addition in the presence of Laccase+Acetosyringone; the experiment conducted as described in Example 8.

DETAILED DESCRIPTION OF THE INVENTION

Figure 1:
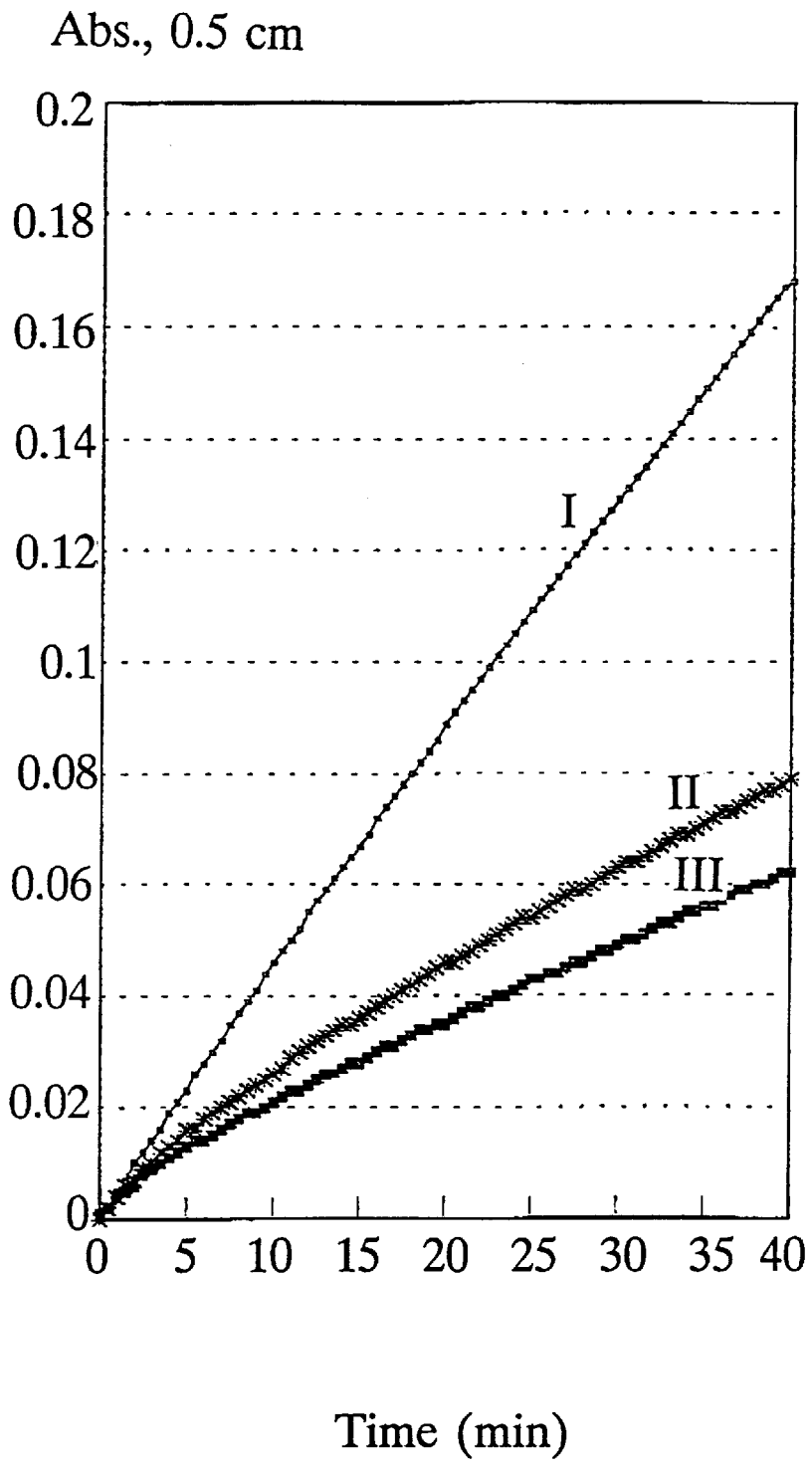

The present invention relates to a method of oxidizing a compound with a phenol oxidizing enzyme, characterized by the presence of an enhancing agent of the following formula:

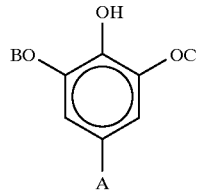

in which formula A is a group such as —D, —CH=CH—D, —CH=CH—CH=CH—D, —CH=N—D, —N=N—D, or —N=CH—D, in which D is selected from the group consisting of —CO—E, —$SO_2$—E, —N—XY, and —$N^+$—XYZ, in which E may be —H, —OH, —R, or —OR, and X and Y and Z may be identical or different and selected from —H and —R; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

In a preferred embodiment A in the above mentioned formula is —CO—E, in which E may be —H, —OH, —R, or —OR; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

In the above mentioned formula A may be placed meta to the hydroxy group instead of being placed in the paraposition as shown.

In particular embodiments, the enhancing agent is acetosyringone, syringaldehyde, methylsyringate, syringic acid, ethylsyringate, propylsyringate, butylsyringate, hexylsyringate, octylsyringate or ethyl 3-(4-hydroxy-3,5-dimethoxyphenyl)acrylate.

The enhancing agent of the invention may be present in concentrations of from 0.01 to 1000 $\mu$M, more preferred 0.1 to 250 $\mu$M, most preferred 1 to 100 $\mu$M.

Preparation of Enhancing Agents

The enhancing agents described in the present application may be prepared using methods well known to those skilled in the art; some of the enhancing agents are also commercially available.

We produced methylsyringate, ethylsyringate, propylsyringate, butylsyringate, hexylsyringate and octylsyringate by using the method disclosed in *Chem. Ber.* 67, 1934, p. 67.

Ethyl 3-(4-hydroxy-3,5-dimethoxyphenyl)acrylate was synthesised from syringaldehyde and triethyl phosphonoacetate in ethanol/sodium ethanolate. The product was after purification characterised by $^{1}$H-NMR and $^{13}$C-NMR (showing spectra as expected) and the melting point was 68–70° C.

Hydrogen peroxide/Oxygen

If the phenol oxidizing enzyme requires a source of hydrogen peroxide, the source may be hydrogen peroxide or a hydrogen peroxide precursor for in situ production of hydrogen peroxide, e.g., percarbonate or perborate, or a hydrogen peroxide generating enzyme system, e.g., an oxidase and a substrate for the oxidase, e.g., an amino acid oxidase and a suitable amino acid, or a peroxycarboxylic acid or a salt thereof. Hydrogen peroxide may be added at the beginning or during the process, e.g., in an amount corresponding to levels of from 0.001–25 mM, particularly to levels of from 0.01–1 mM.

If the phenol oxidizing enzyme requires molecular oxygen, molecular oxygen from the atmosphere will usually be present in sufficient quantity. If more $O_2$ is needed, additional oxygen may be added.

Phenol Oxidizing Enzyme

In the context of the present invention the enzyme of the phenol oxidizing enzyme may be an enzyme possessing peroxidase activity or a laccase or a laccase related enzyme as described below.

Peroxidases and Compounds possessing Peroxidase Activity

Compounds possessing peroxidase activity may be any peroxidase enzyme comprised by the enzyme classification (EC 1.11.1.7), or any fragment derived therefrom, exhibiting peroxidase activity, or synthetic or semisynthetic derivatives thereof (e.g. porphyrin ring systems or microperoxidases, cf. e.g. U.S. Pat. No. 4,077,768, EP Patent Application 537,381, International Patent Applications WO 91/05858 and WO 92/16634).

Preferably, the peroxidase employed in the method of the invention is producible by plants (e.g. horseradish or soybean peroxidase) or microorganisms such as fungi or bacteria. Some preferred fungi include strains belonging to the subdivision Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucaria* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g. Coprinus, Phanerochaete, Coriolus or Trametes, in particular *Coprinus cinereus* f. microsporus (IFO 8371), *Coprinus macrorhizus, Phanerochaete chrysosporium* (e.g. NA-12) or Trametes (previously called Polyporus), e.g. *T. versicolor* (e.g. PR4 28-A).

Further preferred fungi include strains belonging to the subdivision Zygomycotina, class Mycoraceae, e.g. Rhizopus or Mucor, in particular *Mucor hiemalis.*

Some preferred bacteria include strains of the order Actinomycetales, e.g. *Streptomyces spheroides* (ATTC 23965), *Streptomyces thermoviolaceus* (IFO 12382) or *Streptoverticillum verticillium* ssp. verticillium.

Other preferred bacteria include *Bacillus humilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g. *M. virescens.*

The peroxidase may furthermore be one which is producible by a method comprising cultivating a host cell transformed with a recombinant DNA vector which carries a DNA sequence encoding said peroxidase as well as DNA sequences encoding functions permitting the expression of the DNA sequence encoding the peroxidase, in a culture medium under conditions permitting the expression of the peroxidase and recovering the peroxidase from the culture.

Particularly, a recombinantly produced peroxidase is a peroxidase derived from a Coprinus sp., in particular *C. macrorhizus* or *C. cinereus* according to WO 92/16634.

In the context of this invention, compounds possessing peroxidase activity comprise peroxidase enzymes and peroxidase active fragments derived from cytochromes, haemoglobin or peroxidase enzymes, and synthetic or semisynthetic derivatives thereof, e.g., iron porphyrins, and iron phthalocyanines and derivatives thereof.

Determination of Peroxidase Activity (PODU)

1 peroxidase unit (PODU) is the amount of enzyme that catalyzes the conversion of 1 $\mu$mole hydrogen peroxide per minute at the following analytical conditions: 0.88 mM hydrogen peroxide, 1.67 mM 2,2'-azinobis(3-ethylbenzothiazoline-6-sulfonate), 0.1 M phosphate buffer, pH 7.0, incubated at 30° C., photometrically followed at 418 nm.

Laccase and Laccase Related Enzymes

In the context of this invention, laccases and laccase related enzymes comprise any laccase enzyme comprised by the enzyme classification (EC 1.10.3.2), any catechol oxidase enzyme comprised by the enzyme classification (EC 1.10.3.1), any bilirubin oxidase enzyme comprised by the enzyme classification (EC 1.3.3.5) or any monophenol monooxygenase enzyme comprised by the enzyme classification (EC 1.14.99.1).

The above mentioned enzymes may be derived from plants, bacteria or fungi (including filamentous fungi and yeasts) and suitable examples include a laccase derivable from a strain of Aspergillus, Neurospora, e.g., *N. crassa.* Podospora, Botrytis, Collybia, Fomes, Lentinus, Pleurotus, Trametes, e.g., *T. villosa* and *T. versicolor,* Rhizoctonia, e.g., *R. solani,* Coprinus, e.g., *C. cinereus, C. comatus, C. friesii,* and *C. plicatilis,* Psathyrella, e.g., *P. condelleana,* Panaeolus, e.g., *P. Papilionaceus,* Myceliophthora, e.g., *M. thermophila,* Schytalidium, Polyporus, e.g., *P. pinsitus,* Phlebia, e.g., *P. radita* (WO 92/01046), or Coriolus, e.g., *C. hirsutus* (JP 2-238885).

The laccase or the laccase related enzyme may furthermore be one which is producible by a method comprising cultivating a host cell transformed with a recombinant DNA vector which carries a DNA sequence encoding said laccase as well as DNA sequences encoding functions permitting the expression of the DNA sequence encoding the laccase, in a culture medium under conditions permitting the expression of the laccase enzyme, and recovering the laccase from the culture.

Determination of Laccase Activity (LACU)

Laccase activity is determined from the oxidation of syringaldazin under aerobic conditions. The violet colour produced is photometered at 530 nm. The analytical conditions are 19 $\mu$M syringaldazin, 23.2 mM acetate buffer, pH 5.5, 30° C., 1 min. reaction time.

1 laccase unit (LACU) is the amount of enzyme that catalyses the conversion of 1.0 $\mu$mole syringaldazin per minute at these conditions.

Industrial Applications

In a preferred embodiment, the method of the is invention finds application for bleaching of a textile dye or colorant or textile dyes or colorants in solution.

Colorants and dyes are broad classes of natural and synthetic compounds. The following description and examples of dyes/colorants are not intended to be in any way limiting to the scope of the invention as claimed:

Synthetic textile dyes bleachable by the method of the invention are typically azo compounds (with one or several azo, or diazenediyl, groups), as exemplified by Acid Red 151, Direct Blue 1, Direct Brown 44, and Orange II, or anthraquinone compounds, as exemplified by Acid Blue 45:

Acid Red 151

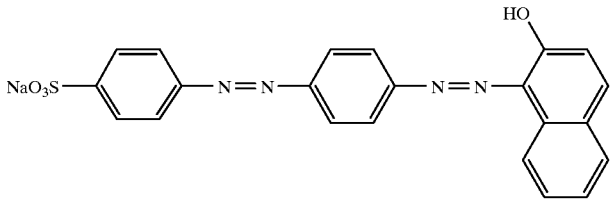

Direct Blue 1

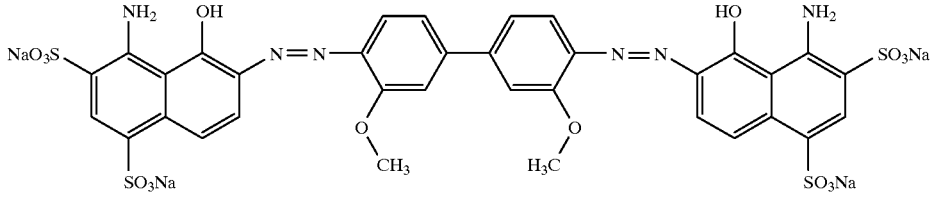

Direct brown 44

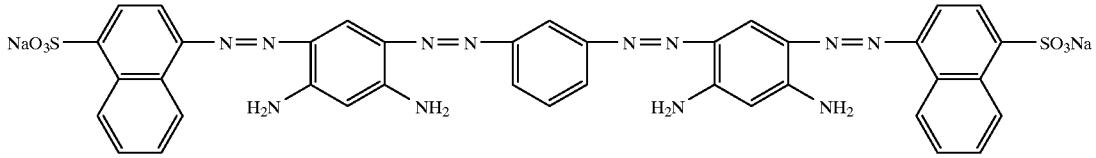

Orange II

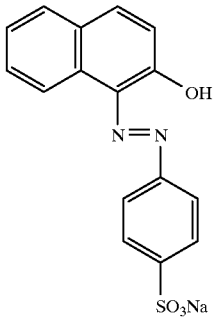

-continued

Acid Blue 45

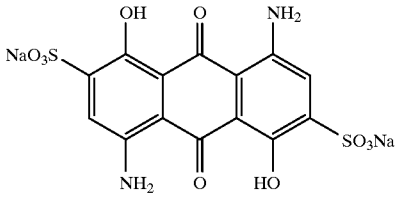

Other structural motifs may occur together with these, as exemplified in the formula of Reactive Blue 19:

Reactive Blue 19

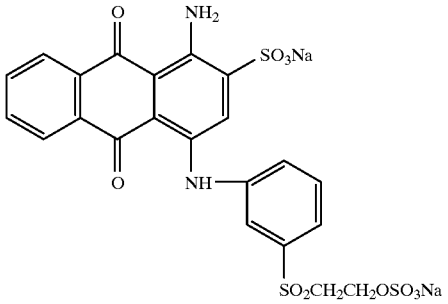

Some dyes furthermore carry groups capable of coupling to fabric surfaces (reactive dyes), and some dyes are complexed to metal ions. These modifications will often not influence the applicability of the present invention.

A different structure bleachable by the method of the invention is the indigo moiety, here exemplified by the soluble dye indigo carmine:

Indigo Carmine

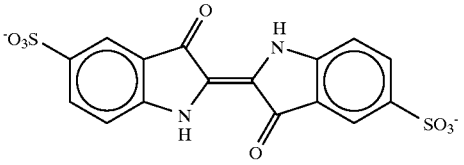

Other dyes and colorants may be of natural origin or may be synthesized as identical to or resembling natural structures. Examples of categories of coloured substances extractable from vegetable sources are polyphenolic, anthocyanine and carotenoid compounds.

A specific embodiment of the present invention is provided by household and institutional laundering processes. In such washing and rinsing processes, dyes and colorants present on fabrics may leach into the washing or rinsing liquor and discoloration of the laundry may result. Bleaching of the coloured compounds in solution by the method of the invention may counteract this undesirable effect. Other systems for dye transfer inhibition are known in the art (e.g. WO 91/05839).

In another specific embodiment, dyes leached into process water during textile processing may be bleached by the method of the invention to prevent undesirable deposition. Other systems are known in the art (e.g. WO 92/18697).

In a third embodiment, the method of the invention finds application in bleaching of pulp for paper production.

Accordingly, the invention provides a method for bleaching of lignin-containing material, in particular bleaching of pulp for paper production, which method comprises treatment of the lignin or lignin containing material with a phenol oxidizing enzyme and an enhancing agent as described in the present invention.

In a fourth embodiment, the method of the invention finds application for lignin modification, e.g., in the manufacture of wood composites, e.g., wood fibre materials such as chipboards, fibre boards, or particle boards, or in the manufacture of laminated wood products, such as laminated beams and plywood.

In a fifth embodiment, the method of the invention finds application in treatment of waste water, e.g., waste water from the chemical or pharmaceutical industry, from dye manufacturing, from dye-works, from the textile industry, or from pulp production (cf. e.g. U.S. Pat. No. 4,623,465, or JP-A-2-31887).

In a more specific aspect, the invention provides a method for treatment of waste water from dye manufacturing, from dye-works, from textile industry, or from pulp manufacturing, the method comprising treatment of the waste water with a phenol oxidizing enzyme in the presence of an enhancing agent of the invention.

In the above mentioned processes and in other applications of the invention, the enhancing agent may be added at the beginning of the process or later, in one or several additions.

According to the invention the phenol oxidizing enzyme may be present in concentrations of from 0.001–100 mg enzyme protein per liter.

Detergent Compositions

According to the invention, the enhancing agent and the phenol oxidizing enzyme may typically be a component of a detergent composition. As such, it may be included in the detergent composition in the form of a detergent additive. Preferred detergent additive formulations are granulates, in particular non-dusting granulates, liquids, in particular stabilized liquids, or slurries.

Non-dusting granulates may be produced, e.g., as disclosed in U.S. Pat. Nos. 4,106,991 and 4,661,452 (both to Novo Industri A/S) and may optionally be coated by methods known in the art. Examples of waxy coating materials are poly(ethylene oxide) products (polyethyleneglycol, PEG) with mean molecular weights of 1000 to 20000; ethoxylated nonyl-phenols having from 16 to 50 ethylene oxide units; ethoxylated fatty alcohols in which the alcohol contains from 12 to 20 carbon atoms and in which there are 15 to 80 ethylene oxide units; fatty alcohols; fatty acids; and mono- and di- and triglycerides of fatty acids. Examples of film-forming coating materials suitable for application by fluid bed techniques are given in patent GB 1483591. Liquid enzyme preparations may, for instance, be stabilized by adding a polyol such as propylene glycol, a sugar or sugar alcohol, lactic acid or boric acid according to established methods. Other enzyme stabilizers are well known in the art. Protected enzymes may be prepared according to the method disclosed in EP 238,216.

The detergent composition of the invention may be in any convenient form, e.g. as powder, granules, paste or liquid. A liquid detergent may be aqueous, typically containing up to 70% water and 0–30% organic solvent, or nonaqueous.

The detergent composition comprises one or more surfactants, each of which may be anionic, nonionic, cationic, or zwitterionic. The detergent will usually contain 0–50% of anionic surfactant such as linear alkylbenzenesulfonate (LAS), alpha-olefinsulfonate (AOS), alkyl sulfate (fatty alcohol sulfate) (AS), alcohol ethoxysulfate (AEOS or AES), secondary alkanesulfonates (SAS), alpha-sulfo fatty acid methyl esters, alkyl- or alkenylsuccinic acid, or soap. It may also contain 0–40% of nonionic surfactant such as alcohol ethoxylate (AEO or AE), carboxylated alcohol ethoxylates, nonylphenol ethoxylate, alkylpolyglycoside, alkyldimethylamine oxide, ethoxylated fatty acid monoethanolamide, fatty acid monoethanolamide, or polyhydroxy alkyl fatty acid amide (e.g. as described in WO 92/06154).

The detergent composition may additionally comprise one or more other enzymes, such as amylases, lipases, cutinases, proteases, and cellulases.

The detergent may contain 1–65% of a detergent builder or complexing agent such as zeolite, diphosphate, triphosphate, phosphonate, citrate, nitrilotriacetic acid (NTA), ethylenediaminetetraacetic acid (EDTA), diethylenetriaminepentaacetic acid (DTPA), alkyl- or alkenylsuccinic acid, soluble silicates or layered silicates (e.g. SKS-6 from Hoechst). The detergent may also be unbuilt, i.e. essentially free of detergent builder.

The detergent may comprise one or more polymers. Examples are carboxymethylcellulose (CMC), poly (vinylpyrrolidone) (PVP), polyethyleneglycol (PEG), poly (vinyl alcohol) (PVA), polycarboxylates such as polyacrylates, maleic/acrylic acid copolymers and lauryl methacrylate/acrylic acid copolymers.

The detergent may additionally contain other bleaching systems which may comprise a $H_2O_2$ source such as perborate or percarbonate which may be combined with a peracid-forming bleach activator such as tetraacetylethylenediamine (TAED) or nonanoyloxybenzenesulfonate (NOBS). Alternatively, the bleaching system may comprise peroxyacids of, e.g., the amide, imide, or sulfone type.

The enzymes of the detergent composition of the invention may be stabilized using conventional stabilizing agents, e.g. a polyol such as propylene glycol or glycerol, a sugar or sugar alcohol, lactic acid, boric acid, or a boric acid derivative such as, e.g., an aromatic borate ester, and the composition may be formulated as described in, e.g., Wo 92/19709 and WO 92/19708.

The detergent may also contain other conventional detergent ingredients such as, e.g., fabric conditioners including clays, foam boosters, suds suppressors, anti-corrosion agents, soil-suspending agents, anti-soil-redeposition agents, dyes, bactericides, optical brighteners, or perfume.

The pH (measured in aqueous solution at use concentration) will usually be neutral or alkaline, e.g., in the range of 7–11.

Particular forms of detergent compositions within the scope of the invention include:

1) A detergent composition formulated as a graulate having a bulk density of at least 600 g/l comprising

| | |
|---|---|
| Linear alkylbenzenesulfonate (calculated as acid) | 7–12% |

-continued

1) A detergent composition formulated as a graulate having a bulk density of at least 600 g/l comprising

| | |
|---|---|
| Alcohol ethoxysulfate (e.g. $C_{12-18}$ alcohol, 1–2 EO) or alkyl sulfate (e.g. $C_{16-18}$) | 1–4% |
| Alcohol ethoxylate (e.g. $C_{14-15}$ alcohol, 7 EO) | 5–9% |
| Sodium carbonate (as $Na_2CO_3$) | 14–20% |
| Soluble silicate (as $Na_2O$, $2SiO_2$) | 2–6% |
| Zeolite (as $NaA1SiO_4$) | 15–22% |
| Sodium sulfate (as $Na_2SO_4$) | 0–6% |
| Sodium citrate/citric acid (as $C_6H_5Na_3O_7/C_7H_8O_7$) | 0–15% |
| Sodium perborate (as $NaBO_3.H_2O$) | 11–18% |
| TAED | 2–6% |
| Carboxymethylcellulose | 0–2% |
| Polymers (e.g. maleic/acrylic acid copolymer, PVP, PEG) | 0–3% |
| Enzymes (calculated as pure enzyme protein) | 0.0001–0.1% |
| Minor ingredients (e.g. suds suppressors, perfume, optical brightener, photobleach) | 0–5% |

2) A detergent composition formulated as a granulate having a bulk density of at least 600 g/l comprising

| | |
|---|---|
| Linear alkylbenzenesulfonate (calculated as acid) | 6–11% |
| Alcohol ethoxysulfate (e.g. $C_{12-18}$ alcohol, 1–2 EO) or alkyl sulfate (e.g. $C_{16-18}$) | 1–3% |
| Alcohol ethoxylate (e.g. $C_{14-15}$ alcohol, 7 EO) | 5–9% |
| Sodium carbonate (as $Na_2CO_3$) | 15–21% |
| Soluble silicate (as $Na_2O$, $2SiO_2$) | 1–4% |
| Zeolite (as $NaA1SiO_4$) | 24–34% |
| Sodium sulfate (as $Na_2SO_4$) | 4–10% |
| Sodium citrate/citric acid (as $C_6H_5Na_3O_7/C_7H_8O_7$) | 0–15% |
| Carboxymethylcellulose | 0–2% |
| Polymers (e.g. maleic/acrylic acid copolymer, PVP, PEG) | 1–6% |
| Enzymes (calculated as pure enzyme protein) | 0.0001–0.1% |
| Minor ingredients (e.g. suds suppressors, perfume,) | 0–5 |

3) A detergent composition formulated as a granulate having a bulk density of at least 600 g/l comprising

| | |
|---|---|
| Linear alkylbenzenesulfonate (calculated as acid) | 5–9% |
| Alcohol ethoxylate (e.g. $C_{12-15}$ alcohol, 7 EO) | 7–14% |
| Soap as fatty acid (e.g. $C_{16-22}$ fatty acid) | 1–3% |
| Sodium carbonate (as $Na_2CO_3$) | 10–17% |
| Soluble silicate (as $Na_2O$, $2SiO_2$) | 3–9% |
| Zeolite (as $NaAlSiO_4$) | 23–33% |
| Sodium sulfate (as $Na_2SO4$) | 0–4% |
| Sodium perborate (as $NaBO_3.H_2O$) | 8–16% |
| TAED | 2–8% |
| Phosphonate (e.g. EDTMPA) | 0–1% |
| Carboxymethylcellulose | 0–2% |
| Polymers (e.g. maleic/acrylic acid copolymer, PVP, PEG) | 0–3% |
| Enzymes (calculated as pure enzyme protein) | 0.0001–0.1% |

-continued

| 3) A detergent composition formulated as a granulate having a bulk density of at least 600 g/l comprising | |
|---|---|
| Minor ingredients (e.g. suds suppressors, perfume, optical brightener) | 0–5% |

| 4) A detergent composition formulated as a granulate having a bulk density of at least 600 g/l comprising | |
|---|---|
| Linear alkylbenzenesulfonate (calculated as acid) | 8–12% |
| Alcohol ethoxylate (e.g. $C_{12-15}$ alcohol, 7 EO) | 10–25% |
| Sodium carbonate (as $Na_2CO_3$) | 14–22% |
| Soluble silicate (as $Na_2O$, $2SiO_2$) | 1–5% |
| Zeolite (as $NaAlSiO_4$) | 25–35% |
| Sodium sulfate (as $Na_2SO_4$) | 0–10% |
| Carboxymethylcellulose | 0–2% |
| Polymers (e.g. maleic/acrylic acid copolymer, PVP, PEG) | 1–3% |
| Enzymes (calculated as pure enzyme protein) | 0.0001–0.1% |
| Minor ingredients (e.g. suds suppressors, perfume) | 0–5% |

| 5) An aqueous liquid detergent composition comprising | |
|---|---|
| Linear alkylbenzenesulfonate (calculated as acid) | 15–21% |
| Alcohol ethoxylate (e.g. $C_{12-15}$ alcohol, 7 EO or $C_{12-15}$ alcohol, 5 EO) | 12–18% |
| Soap as fatty acid (e.g. oleic acid) | 3–13% |
| Alkenylsuccinic acid ($C_{12-14}$) | 0–13% |
| Aminoethanol | 8–18% |
| Citric acid | 2–8% |
| Phosphonate | 0–3% |
| Polymers (e.g. PVP, PEG) | 0–3% |
| Borate (as $B_4O_7$) | 0–2% |
| Ethanol | 0–3% |
| Propylene glycol | 8–14% |
| Enzymes (calculated as pure enzyme protein) | 0.0001–0.1% |
| Minor ingredients (e.g. dispersants, suds suppressors, perfume, optical brightener) | 0–5% |

| 6) An aqueous structured liquid detergent composition comprising | |
|---|---|
| Linear alkylbenzenesulfonate (calculated as acid) | 15–21% |
| Alcohol ethoxylate (e.g. $C_{12-15}$ alcohol, 7 EO, or $C_{12-15}$ alcohol, 5 EO) | 3–9% |
| Soap as fatty acid (e.g. oleic acid) | 3–10% |
| Zeolite (as $NaAlSiO_4$) | 14–22% |
| Potassium citrate | 9–18% |
| Borate (as $B_4O_7$) | 0–2% |
| Carboxymethylcellulose | 0–2% |
| Polymers (e.g. PEG, PVP) | |
| Anchoring polymers such as, e.g., lauryl methacrylate/acrylic acid copolymer; molar ratio 25:1; MW 3800 | 0–3% |
| Glycerol | 0–5% |
| Enzymes (calculated as pure enzyme protein) | 0.0001–0.1% |

-continued

| 6) An aqueous structured liquid detergent composition comprising | |
|---|---|
| Minor ingredients (e.g. dispersants, suds suppressors, perfume, optical brighteners) | 0–5% |

| 7) A detergent composition formulated as a granulate having a bulk density of at least 600 g/l comprising | |
|---|---|
| Fatty alcohol sulfate | 5–10% |
| Ethoxylated fatty acid monoethanolamide | 3–9% |
| Soap as fatty acid | 0–3% |
| Sodium carbonate (as $Na_2CO_3$) | 5–10% |
| Soluble silicate (as $Na_2O$, $2SiO_2$) | 1–4% |
| Zeolite (as $NaAlSiO_4$) | 20–40% |
| Sodium sulfate (as $Na_2SO_4$) | 2–8% |
| Sodium perborate (as $NaBO_3.H_2O$) | 12–18% |
| TAED | 2–7% |
| Polymers (e.g. maleic/acrylic acid copolymer, PEG) | 1–5% |
| Enzymes (calculated as pure enzyme protein) | 0.0001–0.1% |
| Minor ingredients (e.g. optical brightener, suds suppressors, perfume) | 0 . 5% |

| 8) A detergent composition formulated as a granulate comprising | |
|---|---|
| Linear alkylbenzensulfonate (calculated as acid) | 8–14% |
| Ethoxylated fatty acid monoethanolamide | 5–11% |
| Soap as fatty acid | 0–3% |
| Sodium carbonate (as $Na_3CO_3$) | 4–10% |
| Soluble silicate (as $Na_2O$, $2SiO_2$) | 1–4% |
| Zeolite (as $NaAlSiO_4$) | 30–50% |
| Sodium sulfate (as $Na_2SO_4$) | 3–11% |
| Sodium citrate (as $C_6H_5Na_3O_7$) | 5–12% |
| Polymers (e.g. PVP, maleic/acrylic acid copolymer, PEG) | 1–5% |
| Enzymes (calculated as pure enzyme protein) | 0.0001–0.1% |
| Minor ingredients (e.g. suds suppressors, perfume) | 0–5% |

| 9) A detergent composition formulated as a granulate comprising | |
|---|---|
| Linear alkylbenzenesulfonate (calculated as acid) | 6–12% |
| Nonionic surfactant | 1–4% |
| Soap as fatty acid | 2–6% |
| Sodium carbonate (as $Na_2CO_3$) | 14–22% |
| Zeolite (as $NaAlSiO_4$) | 18–32% |
| Sodium sulfate (as $Na_2SO_4$) | 5–20% |
| Sodium citrate (as $C_6H_5Na_3O_7$) | 3–8% |
| Sodium perborate (as $NaBO_3.H_2O$) | 4–9% |
| Bleach activator (e.g. NOBS or TAED) | 1–5% |
| Carboxymethylcellulose | 0–2% |
| Polymers (e.g. polycarboxylate or PEG) | 1–5% |
| Enzymes (calculated as pure enzyme protein) | 0.0001–0.1% |
| Minor ingredients (e.g. optical brightener, perfume) | 0–5% |

| 10) An aqueous liquid detergent composition comprising | |
|---|---|
| Linear alkylbenzenesulfonate (calculated as acid) | 15–23% |
| Alcohol ethoxysulfate (e.g. $C_{12-15}$ alcohol, 2–3 EO) | 8–15% |
| Alcohol ethoxylate (e.g. $C_{12-15}$ alcohol, 7 EO, or $C_{12-15}$ alcohol, 5 EO) | 3–9% |
| Soap as fatty acid (e.g. lauric acid) | 0–3% |
| Aminoethanol | 1–5% |
| Sodium citrate | 5–10% |
| Hydrotrope (e.g. sodium toluensulfonate) | 2–6% |
| Borate (as $B_4O_7$) | 0–2% |
| Carboxymethylcellulose | 0–1% |
| Ethanol | 1–3% |
| Propylene glycol | 2–5% |
| Enzymes (calculated as pure enzyme protein) | 0.0001–0.1% |
| Minor ingredients (e.g. polymers, dispersants, perfume, optical brighteners) | 0–5% |

| 11) An aqueous liquid detergent composition comprising | |
|---|---|
| Linear alkylbenzenesulfonate (calculated as acid) | 20–32% |
| Alcohol ethoxylate (e.g. $C_{12-15}$ alcohol, 7 EO, or $C_{12-15}$ alcohol, 5 EO) | 6–12% |
| Aminoethanol | 2–6% |
| Citric acid | 8–14% |
| Borate (as $B_4O_7$) | 1–3% |
| Polymer (e.g. maleic/acrylic acid copolymer, anchoring polymer such as, e.g., lauryl methacrylate/acrylic acid copolymer) | 0–3% |
| Glycerol | 3–8% |
| Enzymes (calculated as pure enzyme protein) | 0.0001–0.1% |
| Minor ingredients (e.g. hydrotropes, dispersants, perfume, optical brighteners) | 0–5% |

| 12) A detergent composition formulated as a granulate having a bulk density of at least 600 g/l comprising | |
|---|---|
| Anionic surfactant (linear alkylbenzenesulfonate, alkyl sulfate, alpha-olefinsulfonate, alpha-sulfo fatty acid methyl esters, alkanesulfonates, soap) | 25–40% |
| Nonionic surfactant (e.g. alcohol ethoxylate) | 1–10% |
| Sodium carbonate (as $Na_2CO_3$) | 8–25% |
| Soluble silicates (as $Na_2O$, $2SiO_2$) | 5–15% |
| Sodium sulfate (as $Na_2SO_4$) | 0–5% |
| Zeolite (as $NaAlSiO_4$) | 15–28% |
| Sodium perborate (as $NaBO_3,4H_2O$) | 0–20% |
| Bleach activator (TAED or NOBS) | 0–5% |
| Enzymes (calculated as pure enzyme protein) | 0.0001–0.1% |
| Minor ingredients (e.g. perfume, optical brighteners) | 0–3% |

13) Detergent formulations as described in 1)–12 wherein all or part of the linear alkylbenzenesulfonate is replaced by ($C_{12}$–$C_{18}$) alkyl sulfate.

| 14) A detergent composition formulated as a granulate having a bulk density of at least 600 g/l comprising | |
|---|---|
| ($C_{12}$–$C_{18}$) alkyl sulfate | 9–15% |
| Alcohol ethoxylate | 3–6% |
| Polyhydroxy alkyl fatty acid amide | 1–5% |
| Zeolite (as $NaAlSiO_4$) | 10–20% |
| Layered disilicate (e.g. SK56 from Hoechst) | 10–20% |
| Sodium carbonate (as $Na_2CO_3$) | 3–12% |
| Soluble silicate (as $Na_2O$, $2SiO_2$) | 0–6% |
| Sodium citrate | 4–8% |
| Sodium percarbonate | 13–22% |
| TAED | 3–8% |
| Polymers (e.g. polycarboxylates and PVP= | 0–5% |
| Enzymes (calculated as pure enzyme protein) | 0.0001–0.1% |
| Minor ingredients (e.g. optical brightener, photo bleach, perfume, suds suppressors) | 0–5% |

| 15) A detergent composition formulated as a granulate having a bulk density of at least 600 g/l comprising | |
|---|---|
| ($C_{12}$–$C_{18}$) alkyl sulfate | 4–8% |
| Alcohol ethoxylate | 11–15% |
| Soap | 1–4% |
| Zeolite MAP or zeolite A | 35–45% |
| Sodium carbonate (as $Na_2CO_3$) | 2–8% |
| Soluble silicate (as $Na_2O$, $2SiO_2$) | 0–4% |
| Sodium percarbonate | 13–22% |
| TAED | 1–8% |
| Carboxymethyl cellulose | 0–3% |
| Polymers (e.g. polycarboxylates and PVP) | 0–3% |
| Enzymes (calculated as pure enzyme protein) | 0.0001–0.1% |
| Minor ingredients (e.g. optical brightener, phosphonate, perfume) | 0–3% |

16) Detergent formulations as described in 1)–15) which contain a stabilized or encapsulated peracid, either as an additional component or as a substitute for already specified bleach systems.

17) Detergent compositions as described in 1), 3), 7), 9) and 12) wherein perborate is replaced by percarbonate.

18) Detergent compositions as described in 1), 3), 7), 9), 12), 14) and 15) which additionally contain a manganese catalyst. The manganese catalyst may, e.g., be one of the compounds described in "Efficient manganese catalysts for low-temperature bleaching", Nature 369, 1994, pp. 637–639.

19) Detergent composition formulated as a nonaqueous detergent liquid comprising a liquid nonionic surfactant such as, e.g., linear alkoxylated primary alcohol, a builder system (e.g. phosphate), enzyme and alkali. The detergent may also comprise anionic surfactant and/or a bleach system.

The following examples further illustrate the present invention, and they are not intended to be in any way limiting to the scope of the invention as claimed.

EXAMPLE 1

Bleaching of Direct Blue 1 with soybean peroxidase with and without acetosyringone A crude soy bean peroxidase (SBP), obtained from Mead Corp., Dayton, Ohio, was purified by anion and cation chromatography followed by gelfiltration to a single protein on SDS-PAGE with an $R_z$-value ($A_{404nm}/A_{280nm}$) of 2.2:

125 ml of crude SBP were adjusted to pH 7, diluted to 2.3 mS and filtered through 0.8 μfilter. The sample was applied to 300 ml DEAE column equilibrated with 20 mM phosphate pH 7.0 and the peroxidase eluted with a 1 M NaCl linear gradient in the same buffer. Fractions with peroxidase activity were pooled.

Pooled fractions from anion exchange chromatography (190 ml) were concentrated and washed by ultrafiltration (GR61PP membrane from Dow, Denmark). pH was adjusted to 5.3 ionic strength to 2.3 mS in the sample before application to a 200 ml S-Sepharose column previously equilibrated with 50 mM acetate pH 5.3. The effluent containing the peroxidase activity was concentrated and washed by ultrafiltration to a final volume of approx. 10 ml.

A 5 ml concentrated sample from cation exchange chromatography was applied to a 90 cm Sephacryl S-200 column equilibrated and eluted with 0.1 M acetate pH 6.1. Fractions with peroxidase activity giving only one band on SDS-PAGE were pooled.

The bleaching rate of Direct Blue 1 (DB1) by the purified SBP was determined using an enhancer according to the invention. The following conditions were used:

| | Final concentration |
|---|---|
| 200 μl 50 mM Britton-Robinson buffer* pH 6, 8 and 10, respectively | 10 mM |
| 200 μl DB1 ~ 3.0 Abs. Units (610 nm) | 0.6 ($A_{610nm}$) |
| 200 μl SBP with $A_{404nm}$ = 0.0005 at pH 6 and 8 or with $A_{404nm}$ = 0.005 at pH 10 | 0.0001 or 0.001 ($A_{404nm}$)** |
| 200 μl 50 μM enhancer | 10 μM |
| 200 μl 100 μM $H_2O_2$ | 20 μM |

*(50 mM acetic acid, 50 mM phosphoric acid, 50 mM boric acid, pH adjusted to the value of interest with NaOH).
**corresponding to approximately to 0.04 mg/l and 0.4 mg/l.

Reagents were mixed in a thermostated cuvette at 30° C. and the bleaching was started by addition of hydrogen peroxide. The bleaching was detected spectrophotometrically at 610 nm, which is the wavelength of the absorption peak of DB1. Bleaching was followed for 4 minutes, and the reduction in absorbance ($100x(A_{610nm,start}-A_{610nm,4min.})/A_{610nm,start}\%$) was determined.

$A_{610nm,start}$ was determined by replacement of hydrogen peroxide with water.

TABLE 1

Bleaching of Direct Blue 1 with SBP in 4 Minutes

| | % DB1 bleaching in 4 min. | | |
|---|---|---|---|
| Enhancer | pH 6 | pH 8 | pH 10 10x[SBP] |
| No | 0.7 | <0.7 | <0.7 |
| acetosyringone | 19.8 | 20.0 | 3.3 |

From the results presented in Table 1 above, it appears that by adding an enhancer of the invention a much faster bleaching of the dye is obtained compared to the experiment without enhancer.

EXAMPLE 2

Bleaching of Direct Blue 1 with Coprinus cinereus peroxidase and without enhancers A *Coprinus cinereus* peroxidase (CiP), obtained as described in WO 9412621 was used.

Dilutions of CiP were made in a solution of 0.15 gram/l of Triton X-405.

The bleaching rate of Direct Blue 1 (DB1) by purified CiP was determined using the following conditions:

| | Final concentration |
|---|---|
| 200 μl 50 mM Britton-Robinson buffer* | 10 mM |
| 200 μl DB1 ~ 3.0 Abs. Units (610 nm) | 0.6 ($A_{610nm}$) |
| 200 μl 0.40 mg/l CiP (pH 8.5) 0.80 mg/l CiP (pH 10.5) | 0.08 mg/l (pH 8.5) or 0.16 mg/l (pH 10.5) |
| 200 μl 25 μM enhancer | 5 μM |
| 200 μl 100 μM $H_2O_2$ | 20 μM |

*(50 mM acetic acid, 50 mM phosphoric acid, 50 mM boric acid, pH adjusted to the value of interest with NaOH).

Reagents were mixed in a thermostated cuvette at 30° C. and the bleaching was started by addition of hydrogen peroxide. The bleaching was detected spectrophotometrically at 610 nm, which is the wavelength of the absorption peak of DB1. Bleaching was followed for 1 minute, and the initial reduction in absorbance, —ΔmAbs/minute, was determined.

TABLE 2

Initial Bleaching of Direct Blue 1 with CiP

| Enhancer | −ΔmAbs/minute | |
|---|---|---|
| pH: | 8.5 | 10.5 |
| Acetosyringone | 239 | 1 |
| Syringaldehyde | 151 | 4 |
| Methylsyringate | 245 | 8 |
| No enhancer | 2 | 0 |

From the results presented in Table 2 above it appears that by adding an enhancer of the invention a much faster bleaching of the dye compared to the experiment without enhancer is obtained. Even at pH 10.5 a significant bleaching with an enhancer of the invention is obtained, whereas no bleaching at all can be seen without the addition of an enhancer.

EXAMPLE 3

Bleaching of Chicago Sky Blue 6B (CSB) with *Coprinus cinereus* peroxidase and enhancers Bleaching tests were performed in exactly the same way as described in Example 2 except that instead of using DB1 Chigaco Sky Blue (CSB) (obtainable from Aldrich) was used, and the following enhancers were tested:

methylsyringate
ethylsyringate
propylsyringate
butylsyringate
hexylsyringate
octylsyringate
ethyl 3-(4-hydroxy-3,5-dimethoxyphenyl)acrylate.

The following results were obtained:

TABLE 3

| Initial Bleaching of CSB with CiP | | |
|---|---|---|
| Enhancer | −ΔmAbs/minute | |
| pH: | 8.5 | 10.5 |
| methylsyringate | 211 | 42 |
| ethylsyringate | 240 | 52 |
| propylsyringate | 228 | 60 |
| butylsyringate | 228 | 48 |
| hexylsyringate | 276 | 36 |
| octylsyringate | 192 | 15 |
| ethyl 3-(4-hydroxy-3,5-dimethoxyphenyl)acrylate | 48 | 48 |
| No enhancer | 8 | 6 |

EXAMPLE 4

Bleaching of Direct Blue 1 (DB1) using various *Coprinaceae laccases* and methylsyringate at pH 5.5–8.5

Bleaching of the dye Direct Blue 1 at various pH values was conducted using a laccase obtained from *Coprinus comatus, Coprinus friesii, Coprinus plicatilis, Panaeolus papilionaceus* or *Psathyrella condolleana* and methylsyringate.

The above mentioned strains were fermented in the following way:

The strains were inoculated on PDA agar plates (PDA: 39 g/l potato dextrose agar) and grown at 26° C. for 3 days. Shake flasks were then inoculated with 6–8 small squares (~0.5 cm×0.5 cm) of agar containing mycelium and fermented for 3–10 days at 26° C. and 200 rpm using the following medium:

| | Deposit no. | Medium | Growth |
|---|---|---|---|
| *Coprinus comatus** | CBS 631.95 | A | 10 days |
| *Coprinus friesii* | CBS 629.95 | A | 3 days |
| *Panaeolus papilionaceus* | CBS 630.95 | A | 10 days |
| *Psathyrella condolleana* | CBS 628.95 | B | 7 days |
| *Coprinus plicatilis* | CBS 627.95 | A | 8 days |

*All the strains mentioned in this Example have been deposited according to the Budapest Treaty on the International Recognition of the Deposits of Microorganisms for the Purpose of Patent Procedures, on 16 August 1995, at Centraalbureau voor Schimmelcultures, Oosterstraat 1, Postbus 273, NL-3740 AG Baarn, Netherlands, under the above mentioned Accession numbers.

| Media: | | | |
|---|---|---|---|
| A: | soja meal | 30 | g/l |
| | maltodextrin | 15 | g/l |
| | bacto peptone | 5 | g/l |
| | pluronic | 0.2 | g/l |
| B: | potato meal | 50 | g/l |
| | barley meal | 25 | g/l |
| | BAN 800MG* | 0.025 | g/l |
| | Na-caseinate | 5 | g/l |
| | crushed soja | 10 | g/l |
| | Na2HPO4, 12 H2O | 4.5 | g/l |
| | Pluronic | 0.05 | ml/l |

*BAN 800MG obtainable from Novo Nordisk A/S.

After fermentation the culture broths were centrifugated and the supernatants were used in the tests described below.

The bleaching rate of DB1 was determined using the following conditions:

| | Final concentration |
|---|---|
| 400 μl 50 mM Britton-Robinson buffer*, (pH 5.5, 7.0, and 8.5 respectively), | 20 mM |
| 200 μl DB1 ~ 3.0 Abs. Units (610 nm) | 0.6 ($A_{610nm}$) |
| 200 μl 50 μM methylsyringate | 10 μM |
| 200 μl laccase at pH 5 and 7: | 4 LACU/l |
| at pH 8.5: | 20 LACU/l |

*(50 mM acetic acid, 50 mM phosphoric acid, 50 mM boric acid, pH adjusted to the value of interest with NaOH).

Reagents were mixed in a 1 ml thermostated cuvette at 30° C. and the bleaching was started by addition of the laccase.

The bleaching was followed spectrophotometrically at 610 nm, which is the wavelength of the absorption peak of DB1, with readings every 5 sec. for a period of 5 minutes. The initial bleaching rate was determined from the first linear part of the absorbance curve.

The following results were obtained with methylsyringate:

| Laccase: | −ΔmAbs/minute | | |
|---|---|---|---|
| pH: | 5.5 | 7.0 | 8.5 |
| *C. comatus* | 33 | 23 | 2 |
| *C. friesii* | 40 | 55 | 61 |
| *Pan. papilionaceus* | 16 | 19 | 18 |
| *Ps. condolleana* | 45 | 54 | 43 |
| *C. plicalitis* | 42 | 39 | 14 |

The following results were obtained with no enhancer:

| Laccase: | −ΔmAbs/minute | | |
|---|---|---|---|
| pH: | 5.5 | 7.0 | 8.5 |
| *C. comatus* | 0 | 0 | 0 |
| *C. friesii* | 0 | 0 | 0 |
| *Ps. condolleana* | 0 | 0 | 0 |
| *C. plicalitis* | 0 | 0 | 0 |

EXAMPLE 5

Bleaching of Direct Blue 1 (DB1) using *Coprinus cinereus* laccase with/without enhancing agents at pH 5.5–8.5

Bleaching of the dye Direct Blue 1 at various pH values was conducted using *Coprinus cinereus* laccase and one of the following enhancing agents:

None
acetosyringone
syringaldehyde
methylsyringate.

The laccase was obtained in the following way: *Coprinus cinereus* (IFO 30116—freely available to the public from Institute of Fermentation, Osaka (IFO) under the indicated deposit number) was inoculated from a PDA agar slant (PDA: 39 g/l potato dextrose agar) into a 100 ml shake flask containing medium A (Medium A is described in Example 3). The culture was cultivated for 6 days at 26° C. and 100 rpm. A 10-liter fermentor containing medium A was inoculated with the 100 ml culture broth. The fermentation ran for 6 days at 26° C. and 100 rpm. The culture broth was filtrated and concentrated by ultrafiltration. Further purification was carried out using hydrophobic interaction chromatography followed by anionic exchange chromatography. This process resultated in a preparation with a laccase activity of 3.6 LACU/ml. The estimated purity was >80% on a protein basis.

The bleaching rate of DB1 was determined using the owing conditions:

| | Final concentration |
|---|---|
| 400 μl 50 mM Britton-Robinson buffer*, (pH 5.5, 7.0 and 8.5 respectively), | 20 mM |
| 200 μl DB1 ~ 3.0 Abs. Units (610 nm) | 0.6 ($A_{610nm}$) |
| 200 μl 50 μM enhancing agent | 10 μM |
| 200 μl *C. cinereus* laccase | 1 mg/l |

*(50 mM acetic acid, 50 mM phosphoric acid, 50 mM boric acid, pH adjusted to the value of interest with NaOH).

Reagents were mixed in a 1 ml thermostated cuvette at 30° C. and the bleaching was started by addition of the laccase.

The bleaching was followed spectrophotometrically at 610 nm, which is the wavelength of the absorption peak of DB1 with readings every 5 sec. for a period of 5 minutes. The initial bleaching rate was determined from the first linear part of the absorbance curve.

The following results were obtained:

| Enhancing agent | −ΔmAbs/minute | | |
|---|---|---|---|
| pH: | 5.5 | 7.0 | 8.5 |
| none | 13 | 5 | 3 |
| aceto-syringone | 28 | 94 | 50 |
| syring-aldehyde | 29 | 79 | 28 |
| methyl-syringate | 20 | 94 | 57 |

EXAMPLE 6

Bleaching of Direct Blue 1 (DB1) using *Coprinus cinereus* laccase and acetosyringone Bleaching of the dye Direct Blue 1 at various pH values was conducted using *Coprinus cinereus* laccase and the enhancing agent acetosyringone.

The laccase was obtained as described in Example 5.

The bleaching rate of DB1 was determined using the following conditions:

| | Final concentration |
|---|---|
| 400 μl 50 mM Britton-Robinson buffer*, (pH 4, 5, 6, 7, and 8 respectively), | 20 mM |
| 200 μl DB1 ~ 3.0 Abs. Units (610 nm) | 0.6 ($A_{610nm}$) |
| 200 μl 50 μM acetosyringone | 10 μM |
| 200 μl *C. cinereus* laccase | 3.2 mg/l |

*(50 mM acetic acid, 50 mM phosphoric acid, 50 mM boric acid, pH adjusted to the value of interest with NaOH).

Reagents were mixed in a 1 cm thermostated cuvette at 30° C. and the bleaching was started by addition of the laccase.

The bleaching was detected spectrophotometrically at 610 nm, which is the wavelength of the absorption peak of DB1. After 5 sec. bleaching was followed for 4 minutes.

The following results were obtained:

| pH | Initial DB1 bleaching (−ΔmAbs/ min) (% of pH 7-value) |
|---|---|
| 4 | 18% |
| 5 | 13% |
| 6 | 35% |
| 7 | 100% |
| 8 | 69% |

It can be seen from the results given above that the optimum bleaching is achieved at pH around 7, but the system also shows an effective bleaching at pH 8.

EXAMPLE 7

Bleaching of Direct Blue 1 with *Trametes villosa* laccase with and without enhancing agents Laccase obtained from *Trametes villosa:* 800 ml culture broth of *Trametes villosa,* CBS 678.70, was filtered with filter aid to give a clear filtrate, which was concentrated and washed by ultrafiltration on a membrane with a cut-off of 6–8 kDa. One ml samples of concentrated preparation was applied onto a Q-Sepharose HP column (Pharmacia, Sweden) equilibrated with 0.1 M fosfate pH 7, and the laccase was eluted with a flat NaCl gradient around 0.25 M. Fractions with laccase activity from 10 runs were pooled and concentrated by ultrafiltration to an activity of 500 LACU/ml.

The following conditions were used:

| | Final concentration |
|---|---|
| 400 μl 50 mM Britton-Robinson buffer*, pH 5.5 and pH 7.0 respectively, | 20 mM |
| 200 μl DB1 ~ 3.0 Abs. Units (610 nm) | 0.6 ($A_{610nm}$) |
| 200 μl 50 μM enhancer | 10 μM |
| 200 μl Enzyme dilution | |

*(50 nM acetic acid, 50 mM phosphoric acid, 50 mM boric acid, pH adjusted to the value of interest with NaOH).

Reagents were mixed in a 1 cm thermostated cuvette at 30° C. and the bleaching was started by addition of enzyme.

The bleaching was detected spectrophotometrically at 610 nm, which is the absorption peak of DB1. After 5 sec. bleaching was followed for 4 minutes.

From the results presented below, it appears that adding enhancers of the invention a much faster bleaching of the dye can be obtained compared to the experiment without enhancer. Enzyme dosages given are in the final incubation mixture.

Bleaching of Direct Blue 1 with *Trametes villosa* laccase, obtained as described above, at pH 5.5 (1.6 mg/l) and pH 7.0 (16 mg/l):

| | DB1 bleaching in 4 minutes (−ΔmAbs/4 min) | |
|---|---|---|
| Enhancer | pH 5.5 | pH 7.0 |
| No enhancer | 0 | 0 |
| Acetosyringone | 447 | 242 |
| Syringaldehyde | 438 | 112 |

EXAMPLE 8

Bleaching of gradually added Acid Blue 45 with *Coprinus cinereus* laccase with and without enhancing agent Ideally, dye transfer inhibition systems for laundry applications should be tested in a real wash where dyed fabrics give off dyes to the wash solution as a result of the combined action of the detergent, temperature and mechanical agitation taking place.

To simulate such a process, however, a magnetically stirred beaker was used as the reaction vessel and dye was added gradually from a stock solution (using a Metrohm 725 dosimat). The solution was monitored spectrophotometrically using a Zeiss multichannel spectrometer (MCS) equipped with a fibre-optics immersion probe.

Stock solutions of acetosyringone was prepared in a suitable water/ethanol mixture. Stock solutions of the anthraquinone dye Acid Blue 45 were made with water.

The laccase was recovered from a 10-liter fermentation of *Coprinus cinereus* (IFO 30116) as described in Example 4.

The following conditions were used in the experiment:

Temperature: 35° C.

Medium and pH: 50 nM/50 mM phosphate/borate buffer at pH 10

Acetosyringone (when applicable): 10 $\mu$M

Laccase: 10 mg/l

Dye addition program: linear addition at a rate of ca 0.34 bs/40 min, referring to the absorbance of Acid Blue 45 at its maximum absorbance wavelength (590 nm for Acid Blue 45).

FIG. 1 shows the results of the bleaching tests. The following symbols are used: (I): Only dye addition; (II): Dye addition in the presence of Laccase; (III): Dye addition in the presence of Laccase+acetosyringone.

It can be seen from FIG. 1 that the bleaching effect is enhanced by acetosyringone.

EXAMPLE 9

Dye Transfer Inhibition Using *Coprinus cinereus* Laccase

A small-scale experiment was carried out in which clean cotton test pieces were washed together with dyed fabrics bleeding dye into the wash solution, the experiment conducted in the absence and in the presence of laccase and enhancing agent.

After wash, the Hunter colour difference between the above mentioned cotton pieces and clean cotton pieces (washed in the absence of bleeding fabrics) was measured and taken as a measure of the degree of dye transfer resulting from the wash.

Materials used:

Bleeding fabrics dyed with Acid Red 151 (AR 151) or Direct Blue 1 (DB1).

Clean white cotton (bleached, no optical brightener added).

Liquid detergent and powder detergent as typically met in the North American market place; both detergents contained no bleaching system.

*Coprinus cinereus* laccase, obtained as described in Example 4.

Washing procedure:

The washing processes were carried out in beakers with magnetical stirring at 35° C. for 15 min., after which the test fabrics were rinsed thoroughly in tap water and air-dried overnight in the dark before the Hunter readings were taken by using a Datacolor Elrephometer 2000 reflectance spectrometer.

Laccase system: Laccase at a level of 10 mg/l with the enhancing agent acetosyringone at a level of 10 $\mu$M.

The following results were obtained:

Wash in liquid detergent solution (2 g/l, water hardness 6° dH) at pH 8.5:

| | Hunter colour difference (delta E) with respect to white, washed cotton | |
|---|---|---|
| | Cotton washed with AR 151 bleeders | Cotton washed with DB 1 bleeders |
| Wash with no laccase system | 12 | 26 |
| Wash with laccase system | 1 | 7 |

Wash in powder deterrent solution (1 g/l, water hardness 6° dH) at pH 10.0:

| | Hunter colour difference (delta E) with respect to white, washed cotton | |
|---|---|---|
| | Cotton washed with AR 151 bleeders | Cotton washed with DB 1 bleeders |
| Wash with no laccase system | 21 | 29 |
| Wash with laccase system | 4 | 8 |

Typical significant differences in the delta E readings are 2–3 units, so the data reflect significant reduction of dye transfer with the laccase treatments relative to the treatment with no laccase system.

EXAMPLE 10

Dye Transfer Inhibition Using *Myceliophthora thermophila* Laccase

A small-scale experiment was carried out in which clean cotton test pieces were washed together with dyed fabrics bleeding dye into the wash solution, the experiment conducted in the absence and in the presence of laccase and enhancing agent.

After wash, the Hunter colour difference between the above mentioned cotton pieces and clean cotton pieces (washed in the absence of bleeding fabrics) was measured and taken as a measure of the degree of dye transfer resulting from the wash.

Materials used

Bleeding fabrics dyed with Acid Red 151 (AR 151) or Direct Blue 1 (DB1).

Clean white cotton (bleached, no optical brightener added).

Liquid detergent (No. 1) as typically met in the European market place; liquid detergent (No. 2) as typically met in the North American market place.

*Myceliophthora thermophila* laccase, produced as described in PCT/US95/06815).

Washing procedure

The washing processes were carried out in beakers with magnetical stirring at 35° C. for 15 min., after which the test fabrics were rinsed thoroughly in tap water and air-dried overnight in the dark before the Hunter readings were taken by using a Datacolor Elrephometer 2000 reflectance spectrometer.

Laccase systems: *M. thermophila* laccase at a level of 0.87 mg/l with the enhancing agent acetosyringone (AS) or the enhancing agent methylsyringate (MS) at a level of 10 $\mu$M.

The following results were obtained:

Wash in solution of liquid detergent No. 1 (7 g/l. water hardness 12° dH) at an initial pH of 7.0:

| | Hunter colour difference (delta E) with respect to white, washed cotton | |
|---|---|---|
| | Cotton washed with AR 151 bleeders | Cotton washed with DB 1 bleeders |
| Wash with no laccase system | 7 | 27 |
| Wash with AS-based laccase system | 5 | 13 |
| Wash with MS-based laccase system | 4 | 12 |

Wash in solution of liquid detergent No. 2 (2 g/l, water hardness 6° dH) at pH 8.5:

| | Hunter colour difference (delta E) with respect to white, washed cotton | |
|---|---|---|
| | Cotton washed with AR 151 bleeders | Cotton washed with DB 1 bleeders |
| Wash with no laccase system | 14 | 29 |
| Wash with AS-based laccase system | 5 | 10 |
| Wash with MS-based laccase system | 3 | 8 |

Typical significant differences in the delta E readings are 2–3 units, so the data reflect significant reduction of dye transfer with the laccase treatments relative to the treatment with no laccase system.

We claim:

1. A method for bleaching dyes or colorants in a solution, comprising treating the dyes or colorants in the solution with a phenol oxidizing enzyme and an enhancing agent of the following formula:

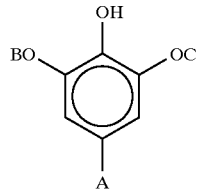

in which formula A is a group such as —D, —CH=CH—D, —CH=CH—CH=CH—D, —CH=N—D, —N=N—D, or —N=CH—D, in which D is selected from the group consisting of —CO—E, —$SO_2$—E, —N—XY, and —N+—XYZ, in which E may be —H, —OH, —R, or —OR, and X and Y and Z may be identical or different and selected from —H and —R; R being a $C_1$–$C_{16}$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

2. A method according to claim 1, in which the enhancing agent is selected from the group consisting of acetosyringone, syringaldehyde, methylsyringate and syringic acid.

3. A method according to claim 1, in which the phenol oxidizing enzyme is a peroxidase and a hydrogen peroxide source.

4. A method according to claim 3, wherein the peroxidase is horseradish peroxidase, soybean peroxidase or a peroxidase enzyme derived from *Coprinus, Bacillus, or Myxococcus*.

5. A method according to claim 3, wherein the hydrogen peroxide source is hydrogen peroxide or a hydrogen peroxide precursor, or a hydrogen peroxide generating enzyme system, or a peroxycarboxylic acid or a salt thereof.

6. A method according to claim 1, in which the phenol oxidizing enzyme is a laccase enzyme together with oxygen.

7. A method according to claim 6, wherein the laccase is derived from Trametes, or Coprinus.

8. A method according to claim 1, in which said method is a method for inhibiting the transfer of a textile dye from a dyed fabric to another fabric when said fabrics are washed together in a wash liquor.

9. A method according to claim 8, in which the enhancing agent is added at the beginning of, or during the process.

10. A method according to claim 8, in which the concentration of the enhancing agent is in the range of from 0.01–1000 $\mu$M.

* * * * *